US009562694B2

(12) United States Patent
Paller et al.

(10) Patent No.: US 9,562,694 B2
(45) Date of Patent: Feb. 7, 2017

(54) DOUBLE OVEN RANGE APPLIANCE AND A GAS BURNER AND FLOOR ASSEMBLY FOR AN OVEN APPLIANCE

(71) Applicant: General Electric Company, Schenectady, NY (US)

(72) Inventors: Hans Juergen Paller, Louisville, KY (US); Joshua Adam Mayne, Charlestown, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 672 days.

(21) Appl. No.: 14/048,322

(22) Filed: Oct. 8, 2013

(65) Prior Publication Data

US 2015/0096550 A1 Apr. 9, 2015

(51) Int. Cl.
*F24C 3/08* (2006.01)
*F23D 14/10* (2006.01)

(52) U.S. Cl.
CPC ..... *F24C 3/087* (2013.01); *F23D 14/10* (2013.01)

(58) Field of Classification Search
CPC ..... F24C 15/00; F24C 15/006; F24C 15/30; F24C 14/025; F24C 3/087; F23D 14/10
USPC ..... 126/21 R, 19 R, 278
See application file for complete search history.

(56) References Cited

U.S. PATENT DOCUMENTS

| | | | | | |
|---|---|---|---|---|---|
| 866,143 | A * | 9/1907 | Kirk | F24C 3/085 | 126/39 C |
| 1,062,670 | A * | 5/1913 | Tinnerman | F24C 15/10 | 126/36 |
| 3,422,809 | A | 1/1969 | Perry | | |
| 3,624,742 | A * | 11/1971 | Hurko | F24C 14/025 | 126/21 R |
| 3,638,634 | A * | 2/1972 | Bolitho | A47J 37/0682 | 126/41 R |
| 4,763,638 | A * | 8/1988 | Hurley | F24C 14/025 | 126/21 A |
| 5,038,748 | A * | 8/1991 | Lockwood | F24C 14/025 | 126/19 R |
| 6,267,047 | B1 * | 7/2001 | Mosher, II | A47J 37/0786 | 99/339 |
| 6,758,206 | B1 | 7/2004 | Barnes et al. | | |
| 6,830,045 | B2 * | 12/2004 | Brock | F24C 3/087 | 126/19 R |
| 7,954,485 | B2 | 6/2011 | Cadima et al. | | |
| 2012/0037142 | A1 | 2/2012 | Chilton et al. | | |

* cited by examiner

*Primary Examiner* — Jorge Pereiro
(74) *Attorney, Agent, or Firm* — Dority & Manning, P.A.

(57) ABSTRACT

A double oven range appliance and a gas burner and floor assembly for an oven appliance are provided. The gas burner and floor assembly includes a cooking chamber bottom panel with a projection defining a plurality of openings. A gas burner is positioned above the plurality of openings. A floor panel is positioned below the cooking chamber bottom panel. An insulation panel is mounted to the floor panel such that the insulation panel is disposed below the plurality of openings. The gas burner and floor assembly can assist with limiting heat transfer along a vertical direction while also providing a suitable flow of air at the gas burner.

18 Claims, 5 Drawing Sheets

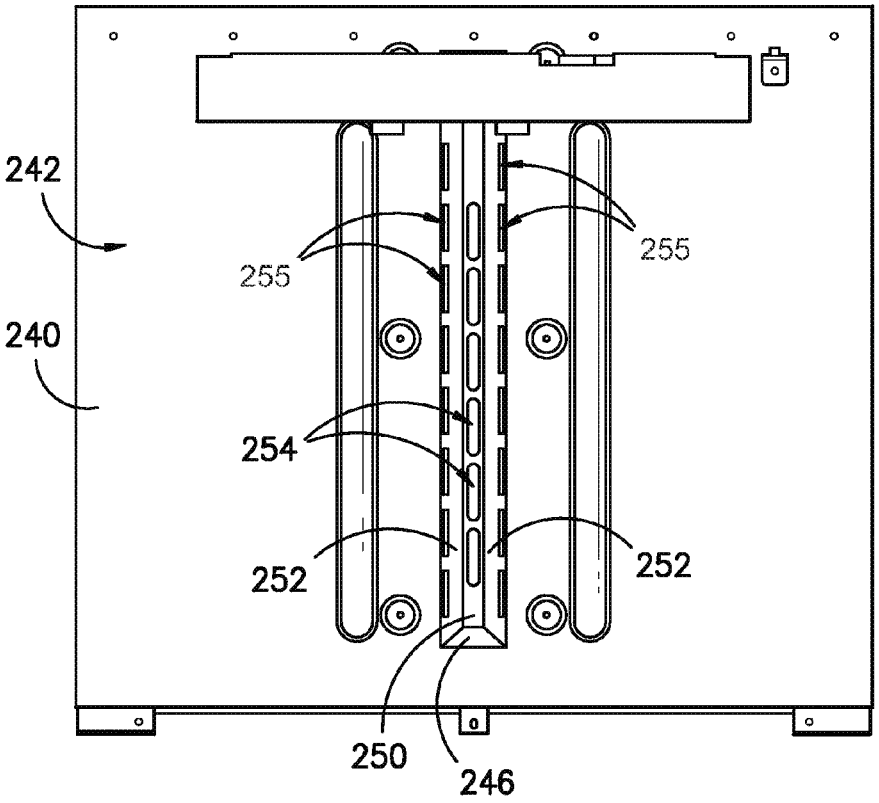
FIG. 5
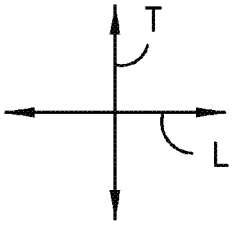

DOUBLE OVEN RANGE APPLIANCE AND A GAS BURNER AND FLOOR ASSEMBLY FOR AN OVEN APPLIANCE

FIELD OF THE INVENTION

The present subject matter relates generally to oven appliances and floor assemblies for the same. In particular, the present subject matter relates to double oven range appliances and floor assemblies for the same.

BACKGROUND OF THE INVENTION

Double oven range appliances generally include a cabinet that defines upper and lower cooking chambers for baking or broiling food items therein as well as a cooktop positioned at a top portion of the cabinet for grilling, boiling or frying food items thereon. To heat the cooking chambers, double oven range appliances include heating elements, such as bake heating elements positioned at bottom portions of the cooking chambers and/or broil heating elements positioned at top portions of the cooking chambers. During operation of such heating elements, the cabinet and other components of the double oven range appliance can be heated. Further, flooring beneath the double oven range appliances can be heated during operation of such heating elements.

Flooring beneath such double oven range appliances is preferably maintained below a threshold temperature during operation of the double oven range appliances. Certain double oven range appliances define a large air gap between the lower cooking chamber and the flooring such that the lower cooking chamber is spaced apart from the flooring by a substantial distance in order to limit heat transfer between the lower cooking chamber and the flooring. However, providing a large air gap between the lower cooking chamber and the flooring has certain drawbacks. For example, vertical heights of the upper and lower cooking chambers can be limited or reduced if a large air gap is provided, and consumers generally prefer large cooking chambers.

Relatively small air gaps also have certain drawbacks. For example, gas burners require a certain volume of air to sustain combustion within the cooking chambers. Small air gaps can hinder or limit air flow to the gas burners and impede performance of the gas burners.

Accordingly, an oven appliance with features for limiting heat transfer to flooring below the oven appliance would be useful. In particular, an oven appliance with features for limiting heat transfer to flooring below the oven appliance while maintaining sufficient air flow to a gas burner of the oven appliance would be useful. Further, an oven appliance with features for limiting heat transfer to flooring below the oven appliance while having a small vertical profile and also maintaining sufficient air flow to a gas burner of the oven appliance would be useful.

BRIEF DESCRIPTION OF THE INVENTION

The present subject matter provides a double oven range appliance and a gas burner and floor assembly for an oven appliance. The gas burner and floor assembly includes a cooking chamber bottom panel with a projection defining a plurality of openings. A gas burner is positioned above the plurality of openings. A floor panel is positioned below the cooking chamber bottom panel. An insulation panel is mounted to the floor panel such that the insulation panel is disposed below the plurality of openings. The gas burner and floor assembly can assist with limiting heat transfer along a vertical direction while also providing a suitable flow of air at the gas burner. Additional aspects and advantages of the invention will be set forth in part in the following description, or may be apparent from the description, or may be learned through practice of the invention.

In a first exemplary embodiment, a double oven range appliance that defines a vertical direction and a transverse direction that are perpendicular to each other is provided. The double oven range appliance includes a cabinet that extends between a top portion and a bottom portion along the vertical direction. The cabinet has an upper cooking chamber positioned adjacent the top portion of the cabinet and a lower cooking chamber positioned adjacent the bottom portion of the cabinet. The double oven range appliance also includes a baking gas burner and a floor assembly positioned at the bottom portion of the cabinet. The floor assembly includes a cooking chamber bottom panel having an upper surface and a projection. The projection extends away from the upper surface of the bottom panel along the vertical direction. The projection defines a plurality of openings that are spaced apart from each other along the transverse direction. The baking gas burner is positioned at the plurality of openings such that the baking gas burner is positioned above the plurality of openings along the vertical direction. A floor panel is positioned below the cooking chamber bottom panel along the vertical direction such that the floor panel and the cooking chamber bottom panel define a baffle therebetween. An insulation panel is mounted to the floor panel such that the insulation panel is disposed below the plurality of openings along the vertical direction.

In a second exemplary embodiment, a gas burner and floor assembly for an oven range appliance is provided. The gas burner and floor assembly define a vertical direction, a lateral direction and a transverse direction. The vertical, lateral and transverse directions are mutually perpendicular. The gas burner and floor assembly includes a baking gas burner extending between a first end portion and a second end portion along the transverse direction. A floor assembly includes a cooking chamber bottom panel having an upper surface and a projection. The projection extends away from the upper surface of the bottom panel along the vertical direction. The projection defines a plurality of openings that are spaced apart from each other along the transverse direction. The baking gas burner is positioned above the plurality of openings along the vertical direction. The plurality of openings is dispersed along the transverse direction between about the first and second end portions of the baking gas burner. A floor panel is positioned below the cooking chamber bottom panel along the vertical direction such that the floor panel and the cooking chamber bottom panel define a baffle therebetween. An insulation panel is mounted to the floor panel such that the insulation panel is disposed below the plurality of openings along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 5 provides a top, plan view of a cooking chamber bottom panel of the exemplary gas burner and floor assembly of FIG. 2.

DETAILED DESCRIPTION

Figure 1:
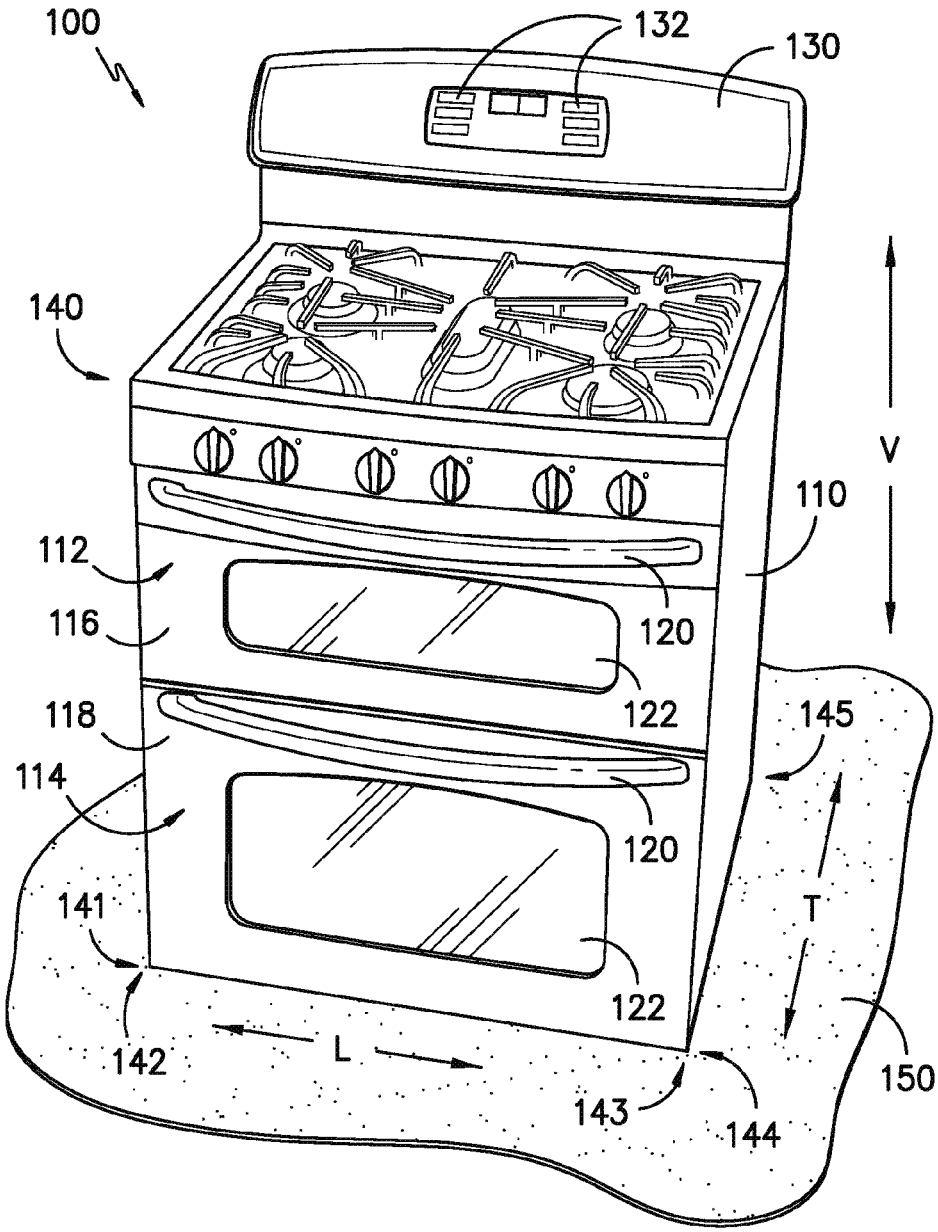
FIG. 1 provides a perspective view of a double oven range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a range appliance 100 according to an exemplary embodiment of the present subject matter. Range appliance 100 defines a vertical direction V, a lateral direction L and a transverse direction T. The vertical, lateral and transverse directions are mutually perpendicular and form an orthogonal direction system. As will be understood by those skilled in the art, range appliance 100 is provided by way of example only, and the present subject matter may be used in any suitable oven appliance, e.g., a single oven range appliance, a single wall oven appliance, a double wall oven appliance, etc.

Range appliance 100 includes an insulated cabinet 110. Cabinet 110 extends between a top portion 140 and a bottom portion 141, e.g., along the vertical direction V. Thus, top and bottom portions 140 and 141 of cabinet 110 are spaced apart from each other, e.g., along the vertical direction V. Cabinet 110 also extends between a first side portion 142 and a second side portion 143, e.g., along the lateral direction L. Thus, first and second side portions 142 and 143 of cabinet 110 are spaced apart from each other, e.g., along the lateral direction L. Cabinet 110 further extends between a front portion 144 and a back portion 145, e.g., along the transverse direction T. Thus, front and back portions 144 and 145 of cabinet 110 are spaced apart from each other, e.g., along the transverse direction T.

As may be seen in FIG. 1, cabinet 110 defines an upper cooking chamber 112 and a lower cooking chamber 114. Thus, range appliance 100 is generally referred to as a double oven range appliance. Upper cooking chamber 112 is positioned at or adjacent top portion 140 of cabinet 110. Conversely, lower cooking chamber 114 is positioned at or adjacent bottom portion 141 of cabinet 110. Thus, upper and lower cooking chambers 112 and 114 are spaced apart from each other along the vertical direction V. Upper and lower cooking chambers 112 and 114 can have any suitable size relative to each other. For example, as shown in FIG. 1, upper cooking chamber 112 can be smaller than lower cooking chamber 114.

Upper and lower cooking chambers 112 and 114 are configured for the receipt of one or more food items to be cooked. Range appliance 100 includes an upper door 116 and a lower door 118 rotatably attached to cabinet 110, e.g., with a hinge (not shown), in order to permit selective access to upper cooking chamber 112 and lower cooking chamber 114, respectively. Handles 120 are mounted to upper and lower doors 116 and 118 to assist a user with opening and closing doors 116 and 118 in order to access cooking chambers 112 and 114. As an example, a user can pull on handle 120 mounted to upper door 116 to open or close upper door 116 and access upper cooking chamber 112. Glass window panes 122 provide for viewing the contents of upper and lower cooking chambers 112 and 114 when doors 116 and 118 are closed and also assist with insulating upper and lower cooking chambers 112 and 114. Heating elements (not shown), such as electric resistance heating elements, gas burners, microwave elements, etc., are positioned within upper and lower cooking chambers 112 and 114 of cabinet 110 for heating upper and lower cooking chambers 112 and 114.

A control panel 130 of range appliance 100 is positioned at top portion 140 and back portion 145 of cabinet 110. Control panel 130 includes user inputs 132. Control panel 130 provides selections for user manipulation of the operation of range appliance 100. For example, a user can touch control panel 130 to trigger one of user inputs 132. In response to user manipulation of user inputs 132, various components of the range appliance 100 can be operated.

As discussed above, lower cooking chamber 114 is positioned at or adjacent bottom portion 141 of cabinet 110. Thus, lower cooking chamber 114 is positioned at or adjacent flooring 150, such as tile, hardwood, linoleum, etc., beneath range appliance 100. During operation of range appliance 100, flooring 150 can be heated. In particular, when baking or broiling food items within lower cooking chamber 114, flooring 150 can be heated due to operation of a heating element (not shown) associated with lower cooking chamber 114. Range appliance 100 includes features for limiting heat transfer, e.g., along the vertical direction V, between range appliance 100 and flooring 150. In such a manner, a temperature of flooring 150 can be maintained below a threshold temperature. Such features are discussed in greater detail below.

Figure 2:
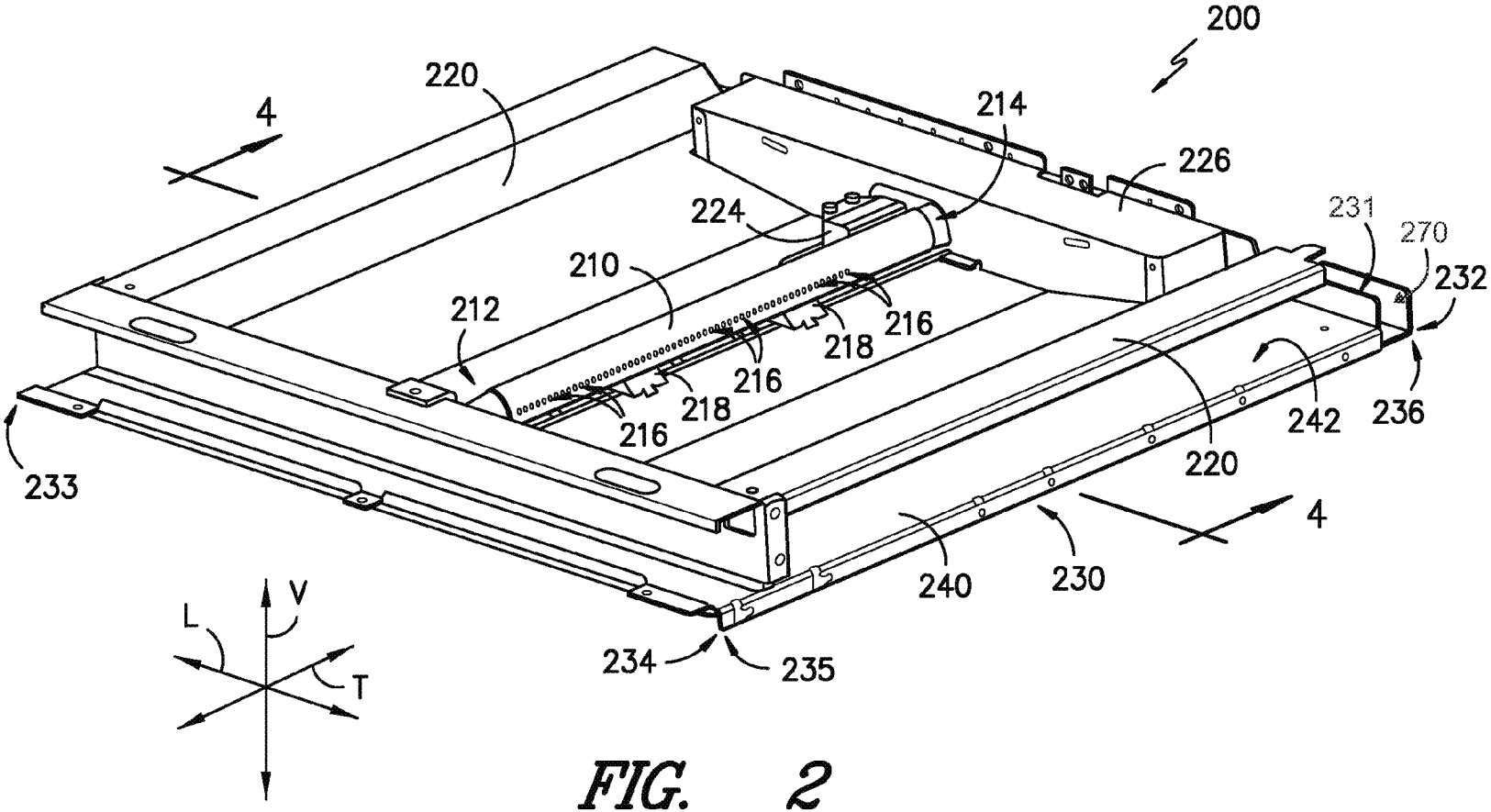
FIG. 2 provides a perspective view of a gas burner and floor assembly according to an exemplary embodiment of the present subject matter.
Figure 3:
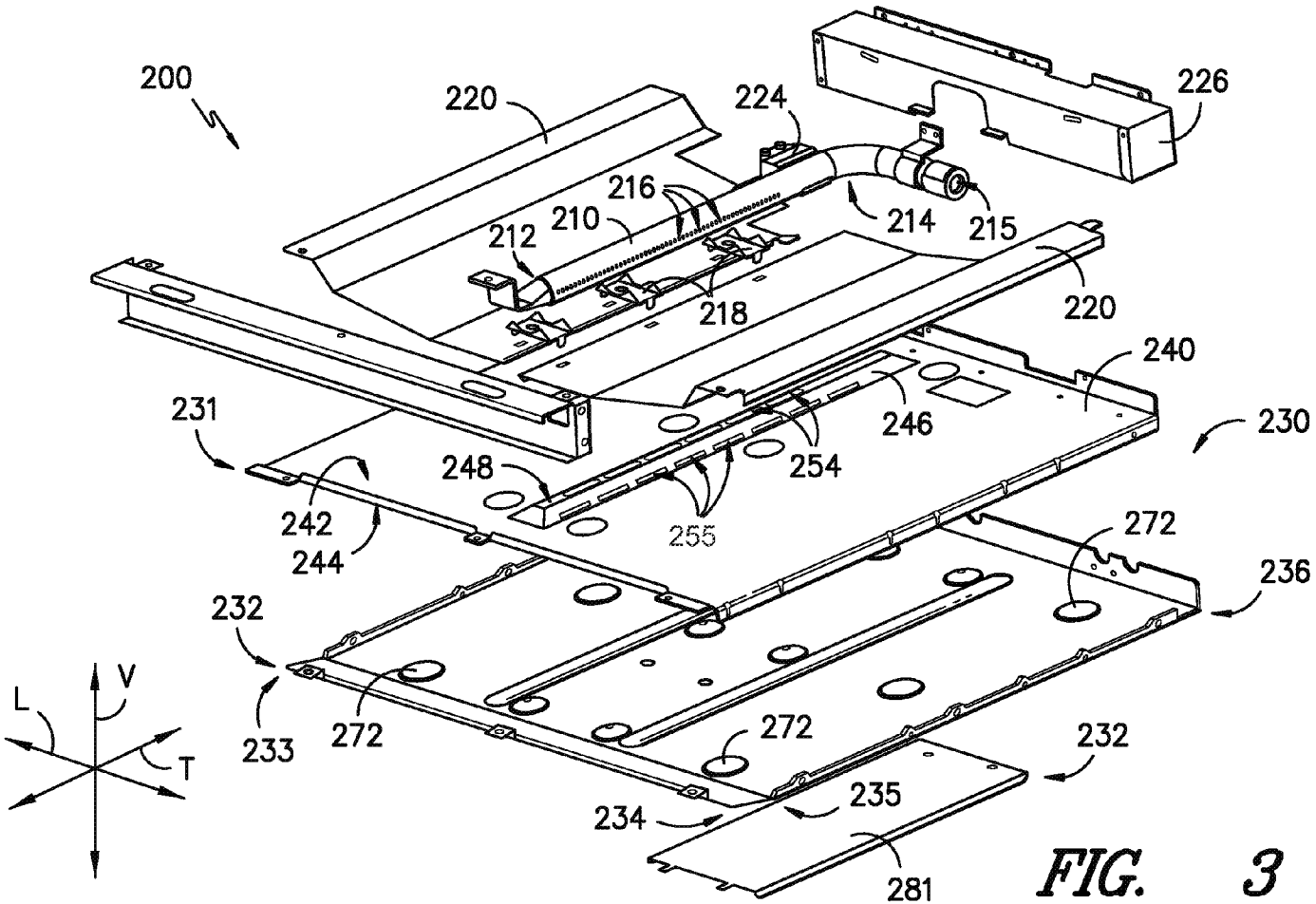
FIG. 3 provides an exploded view of the exemplary gas burner and floor assembly of FIG. 2.

FIG. 2 provides a perspective view of a gas burner and floor assembly 200 according to an exemplary embodiment of the present subject matter. FIG. 3 provides an exploded view of gas burner and floor assembly 200. Gas burner and floor assembly 200 can be used in any suitable oven appliance. For example, gas burner and floor assembly 200 may be used in range appliance 100 (FIG. 1). In particular, gas burner and floor assembly 200 may be positioned at bottom portion 141 of cabinet 110, e.g., between lower cooking chamber 114 and flooring 150 along the vertical direction V. Gas burner and floor assembly 200 is discussed in greater detail below.

As may be seen in FIGS. 2 and 3, gas burner and floor assembly 200 includes a baking gas burner 210. Baking gas burner 210 may be positioned at or adjacent bottom portion 141 of cabinet 110, e.g., within lower cooking chamber 114. Baking gas burner 210 extends between a first end portion 212 and a second end portion 214, e.g., along the transverse direction T. Thus, first and second end portions 212 and 214 of gas burner are spaced apart from each other, e.g., along the transverse direction T. Baking gas burner 210 defines an inlet 215 and a plurality of outlets 216. Gaseous fuel and/or air can enter baking gas burner 210 at inlet 215 of baking gas burner 210. Such gaseous fuel and/or air can flow through baking gas burner 210 and exit baking gas burner 210 at outlets 216 of baking gas burner 210. Outlets 216 of baking gas burner 210 are spaced apart from each other, e.g., along the transverse direction T. In particular, outlets 216 of baking gas burner 210 are distributed or dispersed between first and second end portions 212 and 214 of baking gas burner 210. At outlets 216 of baking gas burner 210, gaseous fuel can be combusted, e.g., to heat lower cooking chamber 114 of cabinet 110.

Gas burner and floor assembly 200 also includes brackets 218 that support baking gas burner 210. Brackets 210 are mounted to a pair of wings 220. Wings 220 are positioned on opposite lateral sides of baking gas burner 210 and can assist with reflecting radiant heat from flames at outlets 216 of baking gas burner 210 upwardly along the vertical direction V. An igniter 224 is positioned at first end portion 212 of baking gas burner 210. Igniter 224 can ignite gaseous fuel at outlets 216 of baking gas burner 210 in order to initiate cooking or cleaning operations in lower cooking chamber 114 of oven range 100. A cover 226 is positioned over inlet 215 of baking gas burner 210 and, e.g., shields inlet 215 of baking gas burner 210 from flames at outlets 216 of baking gas burner 210.

Gas burner and floor assembly 200 also includes a floor assembly 230. Floor assembly 230 may be positioned at or adjacent bottom portion 141 of cabinet 110, e.g., at lower cooking chamber 114. In particular, floor assembly 230 may be positioned between baking gas burner 210 and flooring 150 (FIG. 1). Thus, floor assembly 230 can assist with hindering or limiting heat transfer, e.g., along the vertical direction V to flooring 150. Further, floor assembly 230 can also assist with supplying sufficient air to baking gas burner 210 to permit and sustain suitable combustion of gaseous fuel at outlets 216 of baking gas burner 210. Floor assembly 230 is discussed in greater detail below.

As may be seen in FIG. 2, floor assembly 230 extends between a top portion 231 and a bottom portion 232, e.g., along the vertical direction V. Thus, top and bottom portions 231 and 232 of floor assembly 230 are spaced apart from each other, e.g., along the vertical direction V. Floor assembly 230 also extends between a first side portion 233 and a second side portion 234, e.g., along the lateral direction L. Thus, first and second side portions 233 and 234 of floor assembly 230 are spaced apart from each other, e.g., along the lateral direction L. Floor assembly 230 further extends between a front portion 235 and a back portion 236, e.g., along the transverse direction T. Thus, front and back portions 235 and 236 of floor assembly 230 are spaced apart from each other, e.g., along the transverse direction T.

Floor assembly 230 also includes a cooking chamber bottom panel 240. Cooking chamber bottom panel 240 has an upper surface 242 and a lower surface 244 that are positioned opposite each other on cooking chamber bottom panel 240. In particular, upper surface 242 of cooking chamber bottom panel 240 faces upwardly along the vertical direction V. Conversely, lower surface 244 of cooking chamber bottom panel 240 faces downwardly along the vertical direction V. Cooking chamber bottom panel 240 can assist with limiting or hindering radiant heat transfer downwardly along the vertical direction V, e.g., by reflecting radiant heat from flames at outlets 216 of baking gas burner 210 upwardly along the vertical direction V.

Cooking chamber bottom panel 240 also includes a projection 246. Projection 246 extends away from upper surface 242 of cooking chamber bottom panel 240 along the vertical direction V. In particular, a distal portion 248 of projection 246 is spaced apart from upper surface 242 of cooking chamber bottom panel 240, e.g., along the vertical direction V. Projection 246 defines a plurality of openings 254. Openings 254 of projection 246 are spaced apart from each other, e.g., along the transverse direction T, on projection 246. Baking gas burner 210 is positioned above and/or at openings 254 of projection 246. In particular, baking gas burner 210 is positioned, e.g., directly, above openings 254 of projection 246 along the vertical direction V. Openings 254 of projection 246 are dispersed, e.g., along the transverse direction T, between about first and second end portions 212 and 214 of baking gas burner 210.

Figure 4:
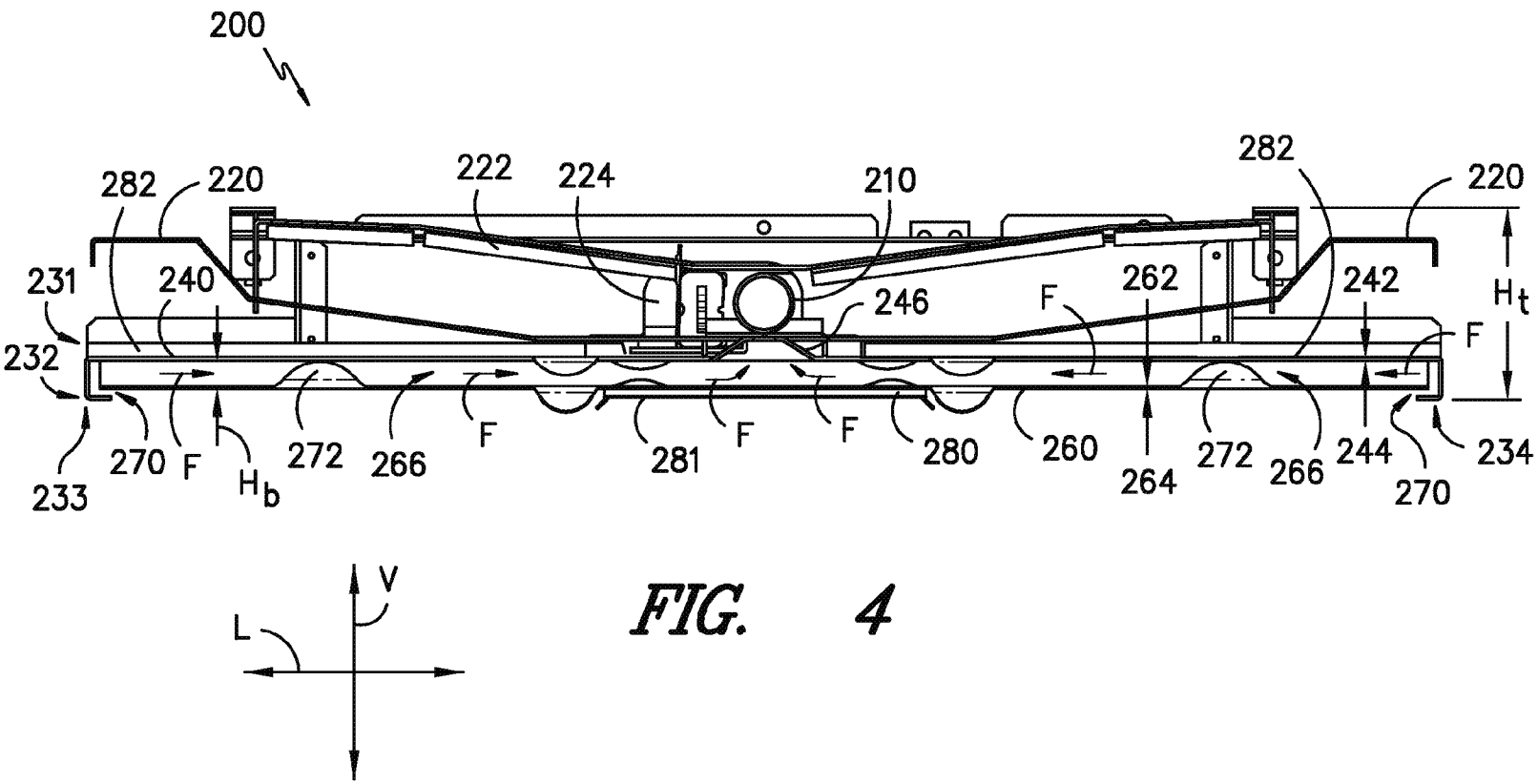
FIG. 4 provides a section view of the exemplary gas burner and floor assembly of FIG. 2 taken along the 4-4 line of FIG. 2.

FIG. 4 provides a section view of gas burner and floor assembly 200 taken along the 4-4 line of FIG. 2. As may be seen in FIG. 4, floor assembly 230 includes a floor panel 260. Floor panel 260 has an upper surface 262 and a lower surface 264 that are positioned opposite each other on floor panel 260. In particular, upper surface 262 of floor panel 260 faces upwardly along the vertical direction V. Conversely, lower surface 264 of floor panel 260 faces downwardly along the vertical direction V. Floor panel 260 can assist with limiting or hindering radiant heat transfer downwardly along the vertical direction V, e.g., by reflecting radiant heat from flames at outlets 216 of baking gas burner 210 that passes through cooking chamber bottom panel 240 upwardly along the vertical direction V.

Floor panel 260 is positioned below cooking chamber bottom panel 240, e.g., such that upper surface 262 of floor panel 260 faces lower surface 244 of cooking chamber bottom panel 240. Thus, floor panel 260 and cooking chamber bottom panel 240 are spaced apart from each other, e.g., along the vertical direction V. In particular, floor panel 260 and cooking chamber bottom panel 240 define a baffle 266 therebetween, e.g., along the vertical direction V. Baffle 266 can have any suitable height (shown with arrow $H_b$) along the vertical direction V. For example, height $H_b$ of baffle 266 may be less than about one half of an inch.

Baffle 266 can assist with limiting conductive heat transfer between cooking chamber bottom panel 240 and floor panel 260. Further, baffle 266 can assist with directing a flow of air (shown with arrows F) towards outlets 216 of baking gas burner 210, e.g., through openings 254 of projection 246. For example, floor panel 260 and cooking chamber bottom panel 240 define inlet openings 270, e.g., between floor panel 260 and cooking chamber bottom panel 240, at first and second side portions 233 and 234 of floor assembly 230 and at back portion 236 of floor assembly 230. Flow of air F can enter baffle 266 at inlet openings 270 and flow through baffle 266 to openings 254 of projection 246. Flow of air F can flow out of baffle 266 at openings 254 of projection 246 such that flow of air F is directed towards outlets 216 of baking gas burner 210. At outlets 216 of baking gas burner 210, flow of air F can facilitate combustion of gaseous fuel from outlets 216 of baking gas burner 210.

Floor panel 260 also includes or defines a plurality of supports 272. Cooking chamber bottom panel 240, e.g., lower surface 244 of cooking chamber bottom panel 240, rests on or is positioned on distal end portions 274 of supports 272. Supports 272 can assist with defining baffle 266 between floor panel 260 and cooking chamber bottom panel 240, e.g., by supporting cooking chamber bottom panel 240 and hindering or preventing downward movement of cooking chamber bottom panel 240 along the vertical direction V relative to floor panel 260.

Floor assembly 230 also includes an insulation panel 280 that is positioned on or mounted to floor panel 260. A cover panel 281 can assist with mounting or supporting insulation panel 280 on floor panel 260. Insulation panel 280 may be positioned on or mounted to either of upper surface 262 or lower surface 264 of floor panel 260. Insulation panel 280 is disposed, e.g., directly, below openings 254 of projection 246 along the vertical direction V. In such a manner, insulation panel 280 can assist with limiting heat transfer along the vertical direction V. Insulation panel 280 can be constructed of any suitable material. For example, insulation panel 280 may be constructed with fiberglass, foam, ceramic, etc.

Insulation panel 280 can have any suitable width along the lateral direction. For example, as may be seen in FIG. 4, a width of insulation panel 280 along the lateral direction L may be greater than a width of projection 246 along the lateral direction L. Thus, insulation panel 280 may be wider along the lateral direction L than projection 246 such that insulation panel 280 is disposed, e.g., directly, below all openings of openings 254 along the lateral and vertical directions L and V.

Floor assembly 230 further includes a pair of insulation panels 282. Insulation panels 282 are positioned on or mounted to upper surface 242 of cooking chamber bottom panel 240. In alternative exemplary embodiments, insulation panels 282 maybe mounted to or positioned on lower surface 244 of cooking chamber bottom panel 240, upper surface 262 of floor panel 260 or lower surface 264 of floor panel 260. Insulation panels 282 are spaced apart from each other, e.g., along the lateral direction L. Thus, each panel of insulation panels 282 may be positioned on or at opposite lateral sides of floor assembly 230, e.g., first and second side portions 233 and 234 of floor assembly 230.

Insulation panels 282 can assist with limiting heat transfer along the vertical direction V. Insulation panels 282 can be constructed of any suitable material. For example, insulation panels 282 may be constructed with fiberglass, foam, ceramic, etc. Insulation panels 282 can have any suitable width along the lateral direction. For example, as may be seen in FIG. 4, each insulation panel of insulation panels 282 may extend along the lateral direction L from a respective one of the first and second side portions 233 and 234 of floor assembly 230 to about projection 246.

Gas burner and floor assembly 200 also includes a flame spreader 222. Flame spreader 222 is positioned above baking gas burner 210, e.g., along the vertical direction V. Flame spreader 222 can assist with distributing heat within lower cooking chamber 114. Flame spreader 222 and floor panel 260 are spaced apart from each, e.g., other along the vertical direction V. In particular, gas burner and floor assembly 200 defines a total height (shown with arrow $H_t$), e.g., along the vertical direction V, between flame spreader 222 and floor panel 260. The total height $H_t$ can be any suitable height. For example, total height $H_t$ may be less than about two inches. In such a manner, gas burner and floor assembly 200 can have a relatively small vertical profile, e.g., such that a vertical height of upper cooking chamber 112 and/or lower cooking chamber 114 can be maximized or increased relative to taller floor assemblies.

FIG. 5 provides a top, plan view of cooking chamber bottom panel 240 of floor assembly 230. As may be seen in FIG. 5, projection 246 includes a top wall 250 and a pair of sidewalls 252. Top wall 250 of projection 246 is spaced apart from upper surface 242 of cooking chamber bottom panel 240, e.g., along the vertical direction V. Sidewalls 252 extend between top wall 250 of projection 246 and upper surface 242 of cooking chamber bottom panel 240. Openings 254 are positioned or defined on top wall 250. Sidewalls 252 also define additional openings 255. Additional openings 255 can act as thermal breaks, e.g., to limit or hinder conductive heat transfer from top wall 250 of projection 246 and cooking chamber bottom panel 240. As may be seen in FIG. 5, both sidewalls 252 can define additional openings 255. To limit air flow through additional openings 255, insulation or another suitable material can be positioned at or within additional openings 255.

Openings 254 of projection 246 can be sized to limit heat transfer, e.g., downwardly along the vertical direction V. In particular, openings 254 of projection 246 define a total opening area that permits flow of air F therethrough to baking gas burner 210. Baking gas burner 210 also has a power output. A ratio of the power output of baking gas burner 210 to the total opening area of openings 254 of projection 246 can be any suitable value. As an example, the power output of baking gas burner 210 may be about fourteen thousand British Thermal Units (BTU) per hour (hr), and the total opening area of openings 254 may be about three and a half inches squared ($in^2$). Thus, the ratio of the power output of baking gas burner 210 to the total opening area of openings 254 of projection 246 may be, e.g., less than, about four thousand BTUs/hr-$in^2$. In such a manner, openings 254 of projection 246 can be sized to hinder or limit radiant heat transfer through openings 254 of projection 246 while supplying sufficient air to support combustion at baking gas burner 210.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A double oven range appliance that defines a vertical direction and a transverse direction that are perpendicular to each other, comprising:

a cabinet that extends between a top portion and a bottom portion along the vertical direction, the cabinet having an upper cooking chamber positioned adjacent the top portion of the cabinet and a lower cooking chamber positioned adjacent the bottom portion of the cabinet;

a baking gas burner; and a floor assembly positioned at the bottom portion of the cabinet, the floor assembly comprising a cooking chamber bottom panel having an upper surface and a projection, the projection extending away from the upper surface of the bottom panel along the vertical direction, the projection including a top wall and a pair of sidewalls, the projection defining a plurality of openings that are spaced apart from each other along the transverse direction, the plurality of openings defined through each sidewall of the pair of sidewalls, the baking gas burner positioned at the plurality of openings defined through the top wall such that the baking gas burner is positioned above the plurality of openings along the vertical direction,wherein the plurality of openings defined through each sidewall are directed towards the upper surface of the bottom panel as a plurality of thermal breaks;

a floor panel positioned below the cooking chamber bottom panel along the vertical direction such that the floor panel and the cooking chamber bottom panel define a baffle therebetween; and an insulation panel mounted to the floor panel such that the insulation panel is disposed below the plurality of openings along the vertical direction.

2. The double oven range appliance of claim 1, wherein the floor panel and the cooking chamber bottom panel are spaced apart from each other such that the baffle has a height along the vertical direction, the height of the baffle being less than about one half of an inch.

3. The double oven range appliance of claim 1, wherein the floor panel includes a plurality of supports, the cooking chamber bottom panel positioned on distal end portions of the plurality of supports in order to support the cooking chamber bottom panel.

4. The double oven range appliance of claim 1, wherein the double oven range appliance defines a lateral direction, the vertical, transverse and lateral directions being mutually perpendicular, further comprising a pair of insulation panels, each insulation panel of the pair of insulation panels positioned on the upper surface of the cooking chamber bottom panel and spaced apart from each other along the lateral direction such that each insulation panel of the pair of insulation panels is positioned on opposite lateral sides of the cooking chamber bottom panel.

5. The double oven range appliance of claim 1, wherein the floor assembly further comprises a flame spreader, the flame spreader positioned above the baking gas burner along the vertical direction, the flame spreader and the floor panel spaced apart from each other along the vertical direction such that the floor assembly has a total height along the vertical direction, the total height of the floor assembly being less than about two inches.

6. The double oven range appliance of claim 1, Wherein the double oven range appliance defines a lateral direction, the vertical, transverse and lateral directions being mutually perpendicular, the floor panel and the cooking chamber bottom panel defining inlet openings at opposite lateral side portions of the floor assembly and at a back portion of the floor assembly.

7. The double oven range appliance of claim 6, wherein the inlet openings are configured for permitting a flow of air into the baffle with the baffle directing the flow of air to the plurality of openings and the flow of air exiting the plurality of openings at the baking gas burner.

8. The double oven range appliance of claim 1, wherein the plurality of openings define a total opening area and the baking gas burner has a power output, a ratio of the power output of the baking gas burner and the total opening area of the plurality of openings being less than about four thousand British Thermal units per hour per inch squared.

9. The double oven range appliance of claim 1, further comprising a pair of wings position on opposite lateral sides of baking gas burner, wherein each wing extends to a position below the baking gas burner and above the plurality of openings defined through each sidewall.

10. A gas burner and floor assembly for an oven range appliance, the gas burner and floor assembly defining a vertical direction, a lateral direction and a transverse direction, the vertical, lateral and transverse directions being mutually perpendicular, the gas burner and floor assembly comprising:

a baking gas burner extending between a first end portion and a second end portion along the transverse direction; and a floor assembly comprising a cooking chamber bottom panel having an upper surface and a projection, the projection extending away from the upper surface of the bottom panel along the vertical direction, the projection including a top wall and a pair of sidewalls,the projection defining a plurality of openings that are spaced apart from each other along the transverse direction, the plurality of openings including a plurality of opening defined through the top wall and a plurality of openings defined through each sidewall of the pair of sidewalls,the baking gas burner positioned above the plurality of openings along the vertical direction, the plurality of openings dispersed along the transverse direction between about the first and second end portions of the baking gas burner, wherein the plurality of openings defined through each sidewall are directed toward the upper surface of the bottom panel as a plurality of thermal breaks;

a floor panel positioned below the cooking chamber bottom panel along the vertical direction such that the floor panel and the cooking chamber bottom panel define a baffle therebetween; and an insulation panel mounted to the floor panel such that the insulation panel is disposed below the plurality of openings along the vertical direction.

11. The gas burner and floor assembly of claim 10, wherein the floor panel and the cooking chamber bottom panel are spaced apart from each other such that the baffle has a height along the vertical direction, the height of the baffle being less than about one half of an inch.

12. The gas burner and floor assembly of claim 10, wherein the floor panel includes a plurality of supports, the cooking chamber bottom panel positioned on distal end portions of the plurality of supports in order to support the cooking chamber bottom panel.

13. The gas burner and floor assembly of claim 10, further comprising a pair of insulation panels, each insulation panel of the pair of insulation panels positioned on the upper surface of the cooking chamber bottom panel and spaced apart from each other along the lateral direction such that each insulation panel of the pair of insulation panels is positioned on opposite lateral sides of the cooking chamber bottom panel.

14. The gas burner and floor assembly of claim 10, wherein the floor assembly further comprises a flame spreader, the flame spreader positioned above the baking gas burner along the vertical direction, the flame spreader and the floor panel spaced apart from each other along the vertical direction such that the floor assembly has a total height along the vertical direction, the total height of the floor assembly being less than about two inches.

15. The gas burner and floor assembly of claim 10, Wherein the floor panel and the cooking chamber bottom panel define inlet openings at opposite lateral side portions of the floor assembly and at a back portion of the floor assembly.

16. The gas burner and floor assembly of claim 15, wherein the inlet openings are configured for permitting a flow of air into the baffle with the baffle directing the flow of air to the plurality of openings and the flow of air exiting the plurality of openings at the baking gas burner.

17. The gas burner and floor assembly of claim 10, wherein the plurality of openings define a total opening area and the baking gas burner has a power output, a ratio of the power output of the baking gas burner and the total opening area of the plurality of openings being less than about four thousand British Thermal Units per hour per inch squared.

18. The gas burner and floor assembly of claim 10, further comprising a pair of wings position on opposite lateral sides of baking gas burner, wherein each wing extends to a position below the baking gas burner and above the plurality of openings defined through each sidewall.

* * * * *